United States Patent [19]

Schrott

[11] 4,307,742

[45] Dec. 29, 1981

[54] ION EXCHANGER REGENERATION WATER SUPPLY CONTROL UNIT

[76] Inventor: Friedrich-Wilhelm H. Schrott, Kirchbühl 93, D 7995 Neukirch, Fed. Rep. of Germany

[21] Appl. No.: 83,357

[22] Filed: Oct. 10, 1979

[30] Foreign Application Priority Data

Nov. 25, 1978 [DE] Fed. Rep. of Germany ..... 2851076
Nov. 25, 1978 [DE] Fed. Rep. of Germany ..... 2851118

[51] Int. Cl.[3] ..... B08B 13/00
[52] U.S. Cl. ..... 134/115 R; 134/93; 68/13 A; 210/191
[58] Field of Search ..... 68/13 A; 134/93, 115 R; 210/167, 191

[56] References Cited

U.S. PATENT DOCUMENTS 3,363,637 1/1968 Rumbaugh et al. ..... 68/13 A X
3,544,371 12/1970 Zinkann ..... 134/93

FOREIGN PATENT DOCUMENTS 3451 8/1979 European Pat. Off. ..... 68/13 A
2501269 7/1976 Fed. Rep. of Germany ... 134/115 R
2613752 10/1977 Fed. Rep. of Germany ... 134/115 R
1551606 11/1968 France ..... 68/13 A
399678 3/1966 Switzerland ..... 134/115 R
482435 12/1969 Switzerland ..... 134/115 R

*Primary Examiner*—Robert L. Bleutge
*Attorney, Agent, or Firm*—Robert R. Thornton

[57] ABSTRACT

Regeneration of an ion exchanger in a dishwasher, in which fresh water for regeneration passes through an airbreak receiving jet into a fresh water supply container which dispenses a preselected variable quantity of water by gravity for regeneration into a salt container, displacing salt solution from the salt container into the ion exchanger, thereby providing rapid collection of the water quantity necessary for ion exchanger regeneration, independent of the water supply pressure. The container is of a flat rectangular configuration and is mounted in the vent aperture of the dishwasher tub. A control valve, accessible through said aperture, controls the quantity of regeneration water dispensed.

10 Claims, 4 Drawing Figures

14A
14B
14
20
21
22
22A
24
10
11
19
19B
19A
13
25
26
27
28
29
30A
30
12
23
15
16
18
17
16
5
7
6
8
30B
9
36
35B
35
31
35A
31A
11A
31B
23A
32
34
33
28A
26A
37
27A
29
12
23A
18A
17A
16A

ION EXCHANGER REGENERATION WATER SUPPLY CONTROL UNIT

DESCRIPTION OF THE PRIOR ART

A dishwasher shown in German Federal Republic Auslegeschrift 26 13 752 has an ion exchanger regeneration reservoir which is filled with fresh water through a water inlet valve controlled by the timer of the dishwasher. Predetermination of the quantity of water to be dispensed is achieved through a cranked swivelling overflow waterpipe, the horizontal arm of which points sideways into the tub of the machine, where it can be reached. According to the angle chosen, the inlet opening of the overflow pipe is positioned at different heights in the reservoir to determine the water quantity selected.

However, such a device requires two apertures in the dishwasher tub, which is used for washing and rinsing, one aperture for water flow and one aperture for tub venting.

There is shown, in German Federal Republic Auslegeschrift No. 25 01 269, a dishwasher with an open receptacle in which leak water from an airbreak is collected for ion exchanger regeneration. The collection takes place during the programmed functions preceding ion exchanger regeneration, as softened water is flowing into the rinsing container and therefore the airbreak is in operation. The water quantity is supplied for regeneration by the programmed opening of a solenoid valve positioned in a conduct between a salt container and the ion exchanger.

However, in such a device, the quantity of leak water is dependent on the pressure in the water supply. If this pressure is too low, not enough water leaks to fill the container and thus properly regenerate the ion exchanger. On the other hand, if the water pressure is too high, there is so much leak water that the quantity of water running into the rinse container after filling the reservoir is no longer negligible. Mixed with the soft water in the rinsing container, such an excessive amount of unsoftened leak water forms a blend which, under certain conditions, will no longer meet the water softness requirements. The quantity of leak water is also dependent upon the construction of the airbreak. Certain designs give too little leak water for exchanger regeneration.

SUMMARY OF THE INVENTION

According to the present invention, an ion exchanger regeneration water supply control unit, including an enclosed throughput reservoir with its own fresh water inlet which includes an airbreak, main outlet and regeneration outlet, is adapted to be connected between a dishwasher fresh water inlet and an ion exchanger in the dishwasher for storage of water in the required quantity for ion exchanger regeneration. The stored water is ducted out of this reservoir upon demand through the regeneration outlet into a salt container which contains a regeneration salt. The throughput reservoir is filled quickly after opening the water inlet through a receiving jet of the airbreak, and thereafter the fresh water flows through the unit into the ion exchanger. Leak water from the airbreak can flow into the dishwater tub through a vent aperture in the tub, which may be used to mount the unit. If softened water from the ion exchanger might be diluted excessively under high water pressure, a design for the airbreak which gives very little leak water is selected.

A preferred embodiment is characterized by the main outlet of the throughput reservoir being disposed in the upper portion thereof, preferably slightly below the inlet opening of the receiving jet of the airbreak, so that the opening remains dry. The incoming water will force air container within the throughput reservoir through the main outlet into the ion exchanger and then into the tub. If this simple way of venting the reservoir during filling is undesirable for some reason, in an alternate embodiment, the reservoir incorporates, in its upper portion, a floating breather valve. When the desired water level of the reservoir is achieved, the floating breather valve seals a vent aperture in the container. When the water level of the reservoir is lowered, additional air can enter through the floating breather valve.

The hardness of the water in public water supplies differs according to locality. With softer water, a smaller quantity of salt solution is required to regenerate the ion exchanger. It is desirable, as far as the usage of salt is concerned, for the quantity of water from the throughput container used to carry the regenerative salt solution to the ion exchanger to be selectively variable to compensate for the local water hardness. Therefore, the throughput reservoir contains several vertical outlet shafts, one or more of which may selectively be connected to the regeneration outlet through a rotatable selector valve located at the bottom of the reservoir. These shafts are constructed to form the walls of chambers. To achieve improved blending of the water in the throughput reservoir, the outlet shafts preferably are of different heights, so as to form passages which protrude into the reservoir from the bottom and terminate at differing water levels near the top of the reservoir. When the unit is mounted in the tub vent aperture, access to the rotatable selector valve may be had through the tub vent aperture.

BRIEF DESCRIPTION OF THE DRAWING

The invention may be more readily understood by referring to the accompanying drawings, in which.

DESCRIPTION OF THE PREFERRED EMBODIMENT

Figures 1, 2, 3, 4:
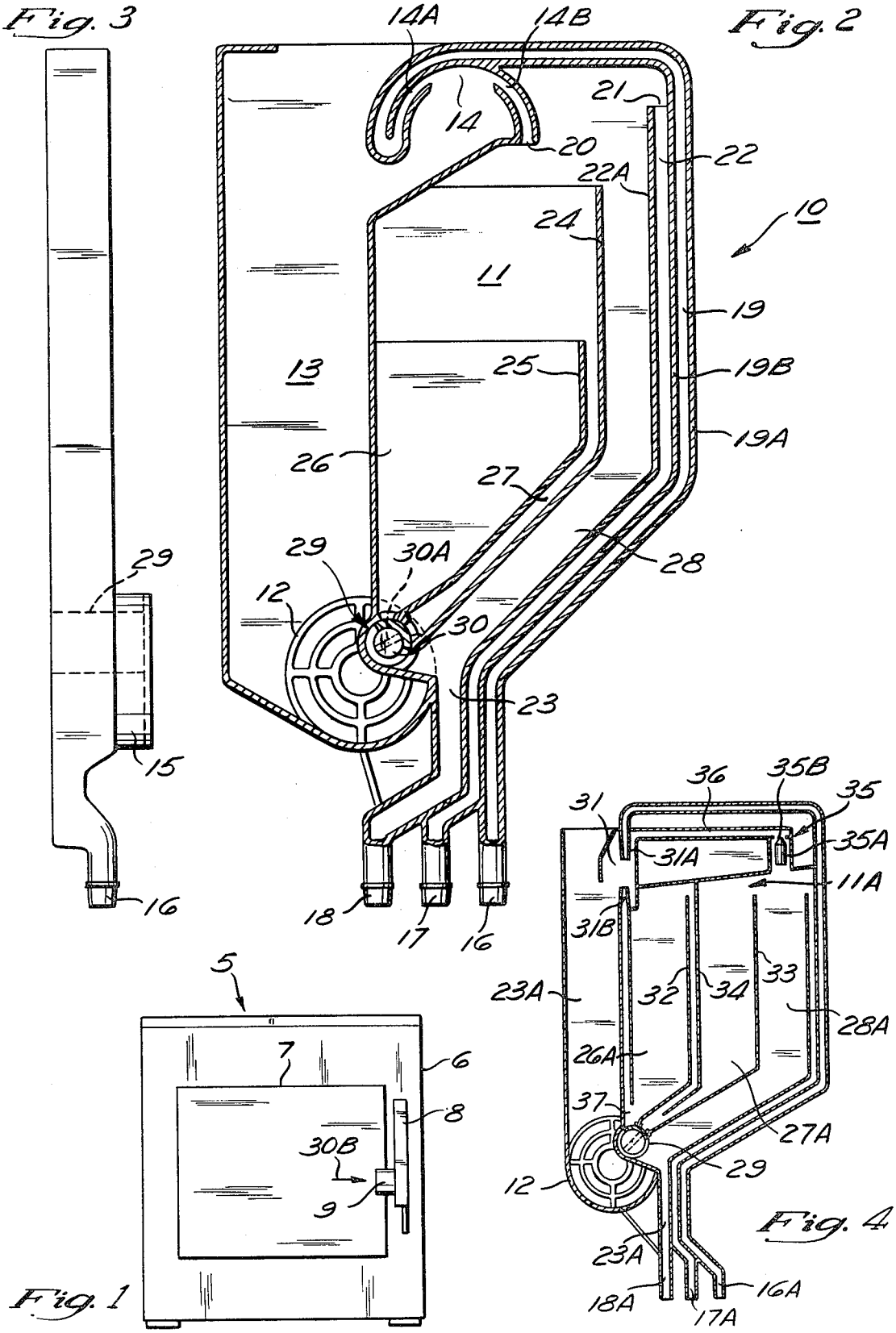
FIG. 1 is a schematic plan view of a dishwasher, illustrating the preferred disposition of an ion exchanger regeneration unit according to the present invention.
FIG. 2 is a front elevation, in cross section, of the ion exchanger regeneration water supply control unit of FIG. 1.
FIG. 3 is a right side elevation thereof.
FIG. 4 is a schematic front elevation, in cross section, of such a unit utilizing a different embodiment of reservoir and airbreak.

Referring now to FIG. 1, there is shown a schematic plan view of a dishwasher 5 having an outer casing or shell 6 and a tub 7 disposed therewithin. The tub 7 functions both as a washing and rinsing tub, in conventional fashion. The tub 7 has a vent aperture 8 formed in one side thereof. A hollow mounting boss 9 extends outwardly from an ion exchanger regeneration water supply control unit 10 into the aperture 8, so as to amount the unit 10 between the tub 7 and the outer wall 6. The dishwasher 5 is otherwise conventional in configuration and operation.

Referring to FIGS. 2 and 3, the ion exchanger regeneration water supply control unit 10 has a throughput reservoir 11, which is a closed container with a grill 12, a breather shaft 13, and airbreak 14. The airbreak 14 consists essentially of two injection moulded plastic parts fused together. The unit 10 is positioned in the upper part of the dishwasher 5 between the tub 7 and the exterior wall 6. The throughput reservoir 11 is inserted into the ventilating aperture 8 which exists in the side wall of the tub 7 with a short connector 15 (see FIG. 3) which functions as the mounting boss 9 and contains the grill 12.

The unit 10 terminates at its bottom in a fresh water inlet nozzle 16, a main outlet nozzle 17 connected to the ion exchanger (not shown), and a regeneration outlet nozzle 18. The airbreak 14 has an inlet jet 14A and a receiving jet 14B.

The dishwasher 5 has a fresh water supply (not shown) which is controlled by a dishwasher timer (not shown) by means of solenoid valve (not shown) and is connected to the fresh water inlet nozzle 16. The fresh water is delivered through a fresh water channel 19, formed by parallel wall surfaces 19A and 19B, 19A being a portion of the outer wall of the unit 10. The fresh water enters the airbreak 14 through the hook shaped inlet jet 14A and passes along the interior of the airbreak 14 to the receiving jet 14B, which opens into a fresh water inlet 20 for the reservoir 11.

A main water flow inlet 21 opens into a main water outlet channel 22 formed by the wall surface 19B and a parallel wall surface 22A. As the water fills the reservoir 11 it overflows into the channel 22 and flows through the main outlet nozzle 17 to the ion exchanger of the dishwasher. A regeneration water flow outlet 23 is connected through the regeneration outlet nozzle 18 to a salt container (not shown) which contains salt for regeneration of the ion exchanger.

It is of particular importance to position main outlet 21 lower than the airbreak 14 as shown in FIG. 2. The receiving jet 14B then remains dry when the machine is inoperative, so that crusts or crystalline deposits cannot form which might impair operation of the airbreak 14.

Two separating walls 24 and 25, preferably differing in height, divide the reservoir into three outlet shafts 26, 27 and 28. The highest outlet shaft 28, which is the main regeneration shaft, goes directly into the regeneration outlet 23. By means of a rotatable valve 29, outlet shaft 27 or shafts 27 and 26, which form supplemental regeneration water supply reservoirs, can be selectively connected to the regeneration outlet 23. The rotatable valve 29 is placed inside the connector 15 at the grill 12. The rotatable valve 29 has a selector plug 30, which can be turned, for example, with a screwdriver from the inside of the tub 7 by means of a slot 30A, indicated by two parallel broken lines, for screwdriver tip insertion. Access to the slot 30A may be had through the tub 7 and connector 15, as is shown by the arrow 30B in FIG. 1.

The arrangement described functions as follows: The interior of the tub 7 connects through the aperture 8 and through the grill 12 to the breather shaft 13 within the housing of the dishwasher, which is open to the surrounding airspace. In this way the tube can be filled and emptied without danger. The steam vapor generated within the tub can also escape through the shaft 13.

When the fresh water inlet nozzle 16 receives fresh water from the dishwasher supply, this fresh water will pass through the airbreak 14 into the initially empty throughput reservoir 11. The connection from the salt container to the ion exchanger is normally closed, so that the regeneration outlet 23 also effectively is closed. Therefore, first the air contained in reservoir 11 will be displaced through the main outlet channel 22, through nozzle 17 and through the ion exchanger into the tub 7. When the reservoir 11 is filled, subsequent fresh water overflows the wall 22A and passes through the main water outlet nozzle 17 to the ion exchanger, from which it is fed as soft water into the tub 7. This path for the water can continue, with interruptions according to the setting of the dishwasher program, for several rinsing operations, until the ion exchanger requires regeneration. Any leak water from airbreak 14 will pass through breather shaft 13 and grill 12 into the tub 7.

When the closed valve between the salt container and ion exchanger is opened for regeneration, the water contained in main regeneration outlet shaft 28 will flow through the regeneration outlet 23 and through the regeneration nozzle 18 into the salt container, and air will enter breather shaft 13 and pass through the airbreak receiving jet 14B and inlet 20 into the reservoir 11. The other two outlet shafts 26 and 27 remain filled to the top of the highest level of separating wall 24. If a greater volume of regeneration water is required, the rotatable valve 29 is rotated counterclockwise to connect supplemental outlet shaft 27 to the regeneration outlet 23. In this position of the rotatable valve 29, both outlet shafts 27 and 28 are discharged and only the water in outlet shaft 26 remains filled to the top of the separating wall 25. If a still greater quantity of water for regeneration is desired, the rotatable valve 29 is further rotated so as to connect the outlet shaft 26 to the outlet shafts 27, 28, so that the entire reservoir 11 will be emptied each regeneration cycle.

The fresh water passing through at inlet 20 causes turbulence in outlet shafts 26 and 27 so as to provide a rinsing action in these shafts, so that even when the position of the outlet valve 29 is as depicted in FIG. 1, the water in outlet shafts 26 and 27 does not remain stagnant for a long time. This turbulence avoids the formation of algae or undesirable deposits in these shafts when only a small amount of regeneration water is required.

The embodiment illustrated in FIG. 4 uses a different type of airbreak 31 with round jets 31A, 31B. A throughput reservoir 11A is divided by two equally high separating walls 32 and 33 into three chambers which can also be selectively connected to a regeneration outlet 23A. A water inlet 37, at the bottom of a left chamber 26A, permits water from the airbreak 31 to flow into and fill the left chamber 26A. Water overflows the wall 32 and is ducted to the bottom of a middle chamber 27A by means of a duct forming wall 34, in order that the chambers shall always be well rinsed for the aforementioned purpose. Furthermore, the throughput reservoir 11A contains a floating breather valve assembly 35. When filling, therefore, the air does not have to be evacuated through the ion exchanger, but it exhausts through the breather valve assembly 35 into a vent channel 36 positioned opposite the chambers 26A, 27A, 28A. When the water level finally rises to the top of the reservoir 11A a float 35A in the breather valve assembly 35 is lifted and will securely close a vent aperture 35B. Any water escaping through the breather valve assembly 35 passes into the vent channel 36 which leads into a breather channel 23A, connected through the grill 12 to the tub 7.

In the embodiments shown, the control valve and an air shaft which lead upward from the vent are combined into one integral unit. In view of the different systems available to fill the tub with fresh water, it is desirable that the unit 10 also incorporate an integral airbreak, shown as a specially designed airbreak with opposed inlet and outlet jet streams, which is connected between the fresh water inlet and the ion exchanger, the leak water of which passes through the vent into the tub or is partly used to fill the reservoir. However, the airbreak could simply be an opening into the tub. Such an integral unit is particularly simple to produce if it consists essentially of two injection moulded parts fused together.

The present invention is based on simplifying a dishwasher incorporating a control device for the preselection of regeneration water and thus simplifying and reducing the cost of production. Instead of two separate apertures in the tub, i.e., one for presetting of the quantity of water and one for the venting of the tub, only a single aperture is necessary, which combines both these functions. The advantage not only consists in the fact that, when manufacturing the tub, instead of two apertures, only one has to be provided, but also the components which previously had to be connected to two separate openings are combined, effectively reducing assembly time and manufacturing costs for these components.

I claim:

1. In a dishwasher having an ion exchanger with a fresh water supply system, apparatus for regeneration of the ion exchanger, including an airbreak with a receiving jet and a reservoir throughput container positioned in the upper part of the dishwasher, from which a preselected quantity of water is dispensed by gravity into an ion regeneration salt container so that salt solution from the salt container is displaced into the ion exchanger to provide for ion exchanger regeneration, characterized by having a closed container positioned between the receiving jet and the ion exchanger, said closed container acting as a throughput water reservoir with an inlet to which a supply of fresh water is connected through the airbreak receiving jet, a main outlet and a regeneration outlet, whereby a predetermined water quantity is selectively dispensed from the container through the regeneration outlet into the salt container, and water overflows from the reservoir through the main outlet.

2. Apparatus according to claim 1 and further characterized by the main outlet of the container having an inlet which is positioned in the upper part of the container.

3. Apparatus according to claim 2 and further characterized by the throughput container having, in its upper part, a floating breather valve assembly, through which the container is vented.

4. Apparatus according to claim 2 and further characterized by the throughput container having a plurality of essentially vertical shafts therewithin so as to form a plurality of reservoir outlets, and including means for connecting a preselected number of said reservoir outlets to the regeneration outlet.

5. Apparatus according to claim 4 and in which the upper ends of the vertical shafts terminate at different heights and said throughput container is vented through the receiving jet.

6. In a dishwasher having an outer wall enclosing a tub, said tub having an air vent aperture formed in the side wall thereof, the combination of a flat reservoir, means for positioning the reservoir in the upper portion of the dishwasher between the tub and the outer wall, means for dispensing a preselected quantity of water from said reservoir into a salt container for the regeneration of an ion exchanger, and control means for preselecting the quantity of water dispensed by the reservoir, said control means being so positioned as to be reachable through the air vent in the side wall of the tub.

7. A dishwasher according to claim 6 and in which the control means is disposed within the air vent aperture.

8. A dishwasher according to claim 6 and having an air shaft leading upwardly from the air vent aperture, said shaft being combined with said control means in one integral reservoir unit.

9. A dishwasher according to claim 8 and in which the reservoir includes an airbreak.

10. A dishwasher according to claims 8 or 9 and in which the reservoir comprises two injection molded parts joined together by fusing.

* * * * *